US006422480B1

(12) United States Patent
Richmond

(10) Patent No.: US 6,422,480 B1
(45) Date of Patent: Jul. 23, 2002

(54) SPINNING SPRAY HEAD AND METHOD

(75) Inventor: Harry Richmond, Houston, TX (US)

(73) Assignee: Universal Minerals, Inc., Tucson, AZ (US)

( * ) Notice: Subject to any disclaimer, the term of this patent is extended or adjusted under 35 U.S.C. 154(b) by 0 days.

(21) Appl. No.: 09/711,843

(22) Filed: Nov. 13, 2000

(51) Int. Cl.[7] ..... B05B 17/04; B05B 3/02

(52) U.S. Cl. ..... 239/10; 239/7; 239/214; 239/223; 239/224; 239/225.1; 239/226; 239/237; 239/263; 239/380; 239/389; 451/102

(58) Field of Search ..... 239/7, 10, 214, 239/214.25, 223, 224, 225.1, 226, 227, 237, 263, 264, 380, 381, 382, 383, 389, 222.21, 236; 451/90, 92, 102

(56) References Cited

U.S. PATENT DOCUMENTS 2,744,361 A * 5/1956 Larson et al.
4,584,000 A * 4/1986 Guest ..... 239/223 X
5,010,694 A * 4/1991 Agbede
6,280,302 B1 * 8/2001 Hashish et al. ..... 451/102

* cited by examiner

*Primary Examiner*—Robin O. Evans
(74) *Attorney, Agent, or Firm*—Mark R. Wisner

(57) ABSTRACT

A nozzle and method for mixing abrasive particles with a stream of water and focusing the mixture of abrasive and water exiting the nozzle to improve the ability of the stream to remove paint and other coatings, rust, and scale and the like from a surface for use in operations such as metal finishing. The nozzle includes a spindle that rotates in a housing, the spindle including a chamber in which water passing through a passage in the spindle is mixed with abrasive particles. The passage through the spindle includes a section that is substantially coincident with the rotational axis of the spindle and a section that is angled relative to the section that is coincident with the rotational axis of the spindle, the mixing chamber being located in the off-axis section of and in fluid communication with the passage through the spindle. The mixture of abrasive and water then exits the nozzle from a focal tube that is also located in the angled section of the passage through the spindle such that the mixed water and abrasive defines a circular pattern that maintains the ability to finish the metal while widening the spray pattern, thereby improving the quality and speed of the metal finishing operation.

7 Claims, 3 Drawing Sheets

SPINNING SPRAY HEAD AND METHOD

BACKGROUND OF THE INVENTION

The present invention relates to an apparatus and method for spraying water with abrasive particles mixed therein. More specifically, the present invention relates to a spray head, or nozzle, for mounting to a rotating lance for mixing abrasive particles with a flow of water for use in such operations as metal finishing.

A number of nozzles for spraying water and abrasive particles under pressure are available for use in metal finishing operations from a number of vendors. Such spray heads are, however, characterized by a number of disadvantages and limitations that decrease their utility. For instance, so far as is known, none of the spray heads that are currently available adequately mix the abrasive particles with the water. Instead, all known nozzles simply entrain the abrasive particles in the stream of water or introduce the abrasive particles into a cone of water that is spraying from the nozzle, thereby dispersing the abrasive particles in the cone of water. Either way, the ability of such spray heads to remove rust, lime scale, and paint and/or other coatings from a surface is compromised because the abrasive is not adequately mixed with the water in the spray. If the size of the spray cone is decreased so as to increase the ability of such spray heads to remove such surface characteristics from the metal, the resulting spray pattern is so small that the job of cleaning the metal is slowed to the point that economy suffers.

There is, therefore, a need for an improved nozzle for spraying abrasive particles in water, and it is an object of the present invention to provide such a nozzle.

It is also an object of the present invention to provide a nozzle for mixing water with abrasive particles for use in such operations as metal finishing.

Another object of the present invention is to provide a method for mixing abrasive particles with water before the water exits a nozzle in a spray.

Another object of the present invention is to provide an apparatus and method for efficient metal finishing operations.

Yet another object of the present invention is to provide an apparatus and method for focusing the mixture of water and abrasive sprayed by a nozzle.

Other objects, and the advantages, of the present invention will be made clear to those skilled in the art by the following description of the presently preferred embodiments thereof.

SUMMARY OF THE INVENTION

These objects are achieved by providing a nozzle for spraying abrasive particles mixed in water comprising a housing with a spindle rotatable in the housing having a passage therethrough for the flow of water, the axis of the first portion of the passage being approximately coincident with the rotational axis of the spindle and the second portion of the passage having an axis that is angled relative to the first portion of the passage. A focal tube is also rotatable in the housing and is provided with a bore therethrough for passing the flow of water from the spindle and out of the housing, the bore through the focal tube being angled relative to the first portion of the passsage through the spindle. An inlet is provided in the second, angled portion of the passage through the spindle for introducing abrasive particles into the flow of water passing through the spindle.

The present invention also provides a method for spraying abrasive particles in water comprising the steps of rotating a spindle having a passage therethrough for passing water in a housing, rotating a focal tube with the spindle, the focal tube having a bore therethrough for passing the water from said spindle out of the housing, and mixing abrasive particles with the water in an off-axis chamber in fluid communication with the passage through the spindle.

DETAILED DESCRIPTION OF THE PREFERRED EMBODIMENT

Figure 1:
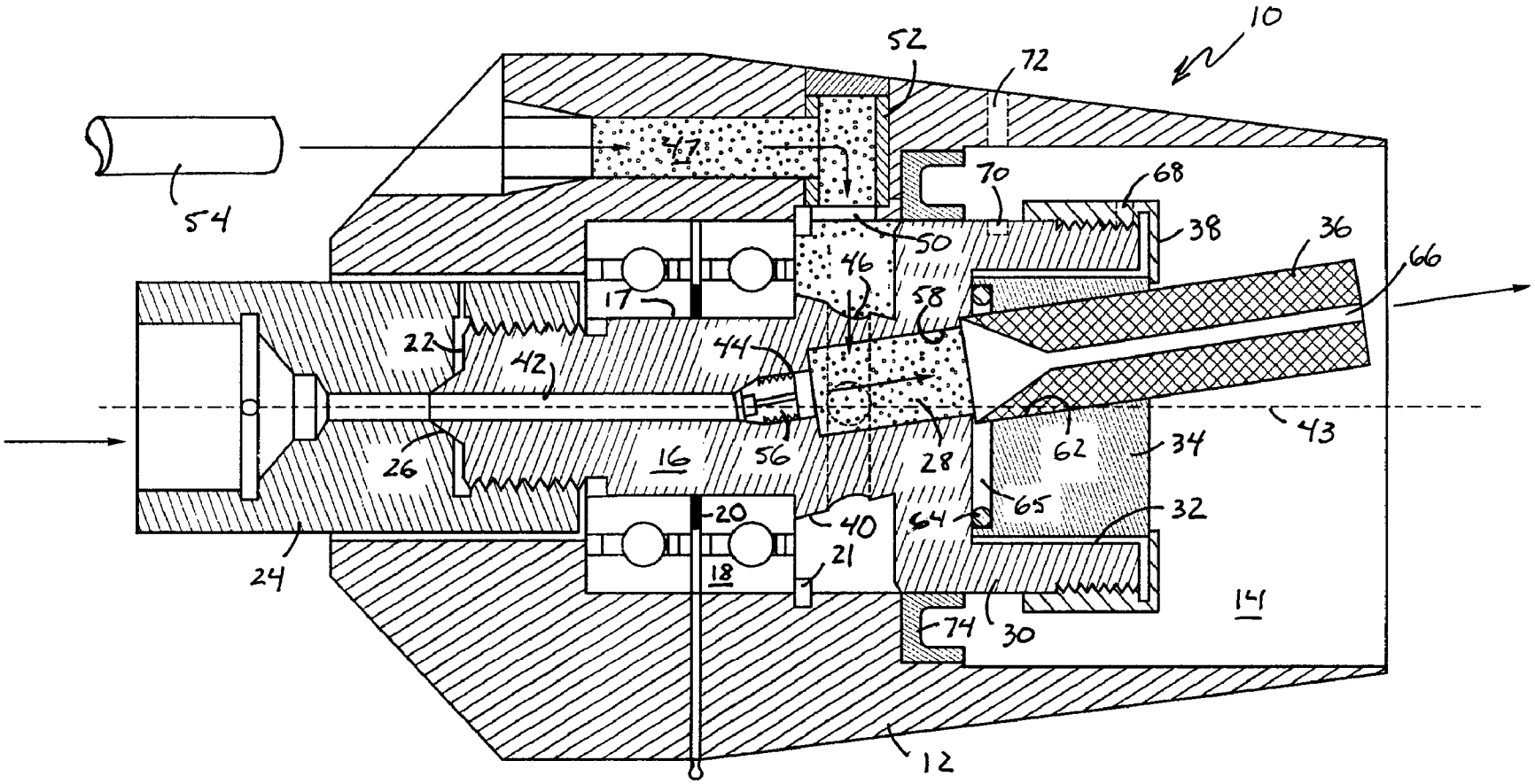
FIG. 1 is a longitudinal sectional view of a preferred embodiment of a rotating nozzle constructed in accordance with the teachings of the present invention.
Figure 2:
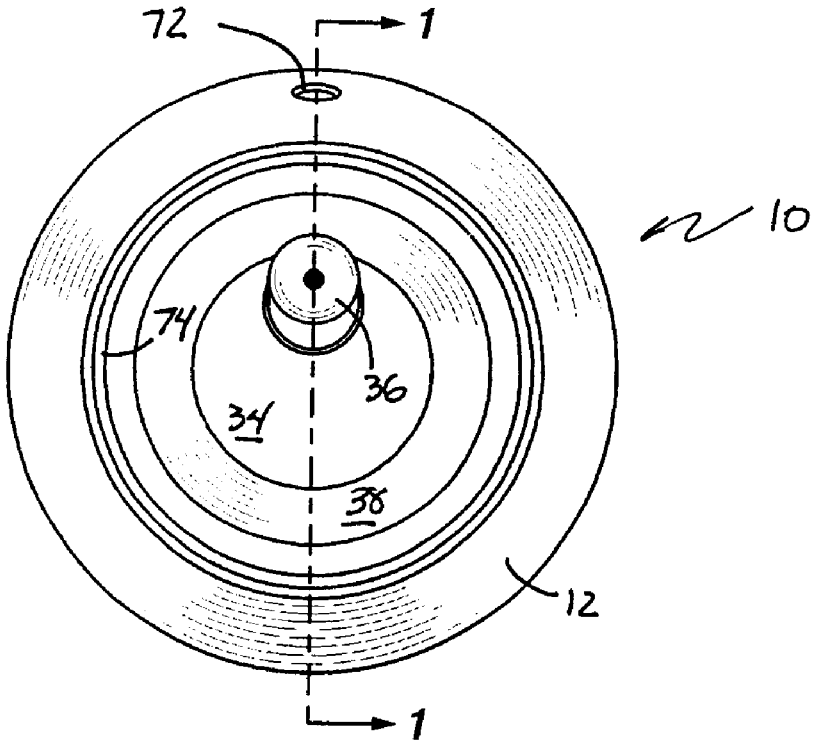
FIG. 2 is an end view of the nozzle of FIG. 1.
Figure 3:
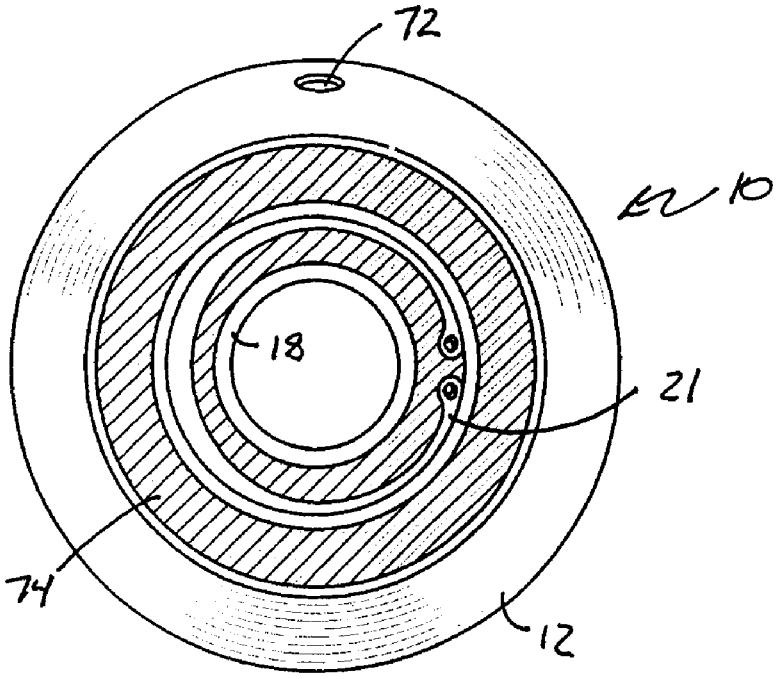
FIG. 3 is an end view of the nozzle of FIG. 1 after removal of the focal tube and spindle from the housing thereof.
Figure 4:
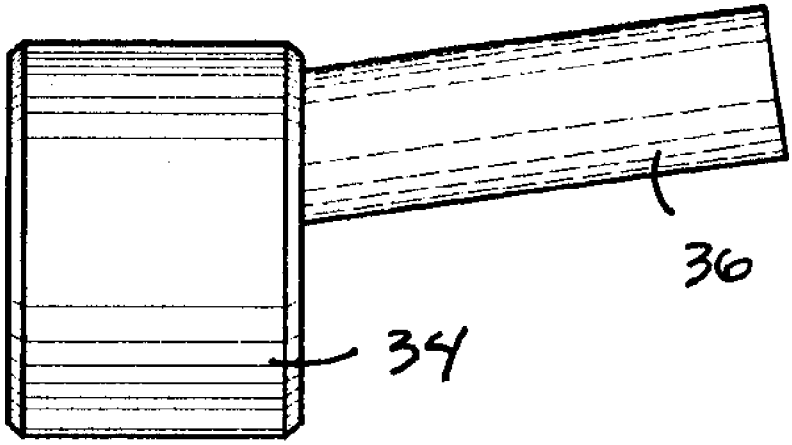
FIG. 4 is a side, elevational view of the focal tube and focal tube housing of the nozzle of FIG. 1 after removal from the housing.

Referring to FIG. 1, a preferred embodiment of a nozzle constructed in accordance with the teachings of the present invention is indicated generally at reference numeral 10. The nozzle 10 comprises a housing 12 having a longitudinal passage 14 therethrough and a spindle 16 rotatable in passage 14. The shaft 17 of spindle 16 is journaled in housing 12 in a pair of bearings 18 spaced far enough apart to allow a grease space 20 and retained in housing 12 by the C-clip 21. The end of shaft 17 is threaded at one end 22 for receiving a collar 24 at a metal to metal seal 26 of a type known in the art. Although not shown in FIG. 1, collar 24 is adapted to fit onto a rotating lance (not shown) of a type known in the art for introducing water under pressure into collar 24 and rotating the collar, and therefore, the spindle 16.

Figure 5:
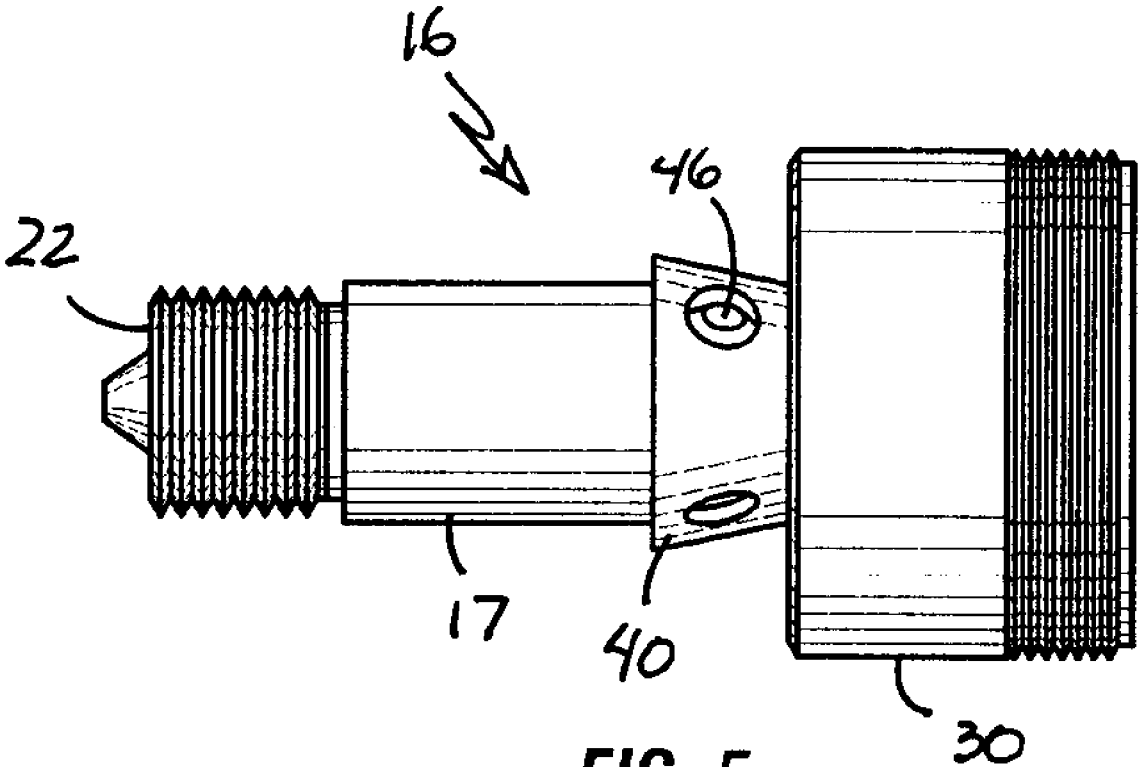
FIG. 5 is a side, elevational view of the spindle of the nozzle of FIG. 1 after removal from the housing.

Referring also to FIG. 5, spindle 16 is further comprised of a mixing chamber 28 and a socket 30, socket 30 comprising the end of spindle 16 opposite the threaded end 22 of shaft 17. The socket 30 is provided with a bore 32 for receiving a focal tube housing 34 having a focal tube 36 mounted therein and threads (not numbered) for retaining a locking collar 38 thereon, the locking collar 38 functioning to retain the focal tube housing 34 in the bore 32 of spindle 16. Spindle 16 is retained in housing 12 by the threaded engagement engagement of the shaft 17 to collar 24, the end of collar 24 engaging the bearings 18, and by engagement of the enlarged portion 40 of spindle 16 in the section of spindle 16 housing the mixing chamber 48.

Spindle 16 is provided with a longitudinal passage having a first section 42 that is substantially coincident with the axis of rotation 43 of the spindle 16 in housing 12. A second section 44 of the longitudinal passage through spindle 16 extends through the socket 30 and enlarged portion 40 of spindle 16 and is angled relative to the first section 42 of the passage. One or more inlets 46 is provided in the enlarged portion 42 of spindle 16 for introduction of abrasive particles 47 into the mixing chamber 28 that is in fluid communication with the second section 44 of the longitudinal passage through spindle 16. Because the mixing chamber 28 is located in the second section 44 of the passage through spindle 16, mixing chamber 28 is not coincident with the rotational axis 43 of spindle 16, e.g., mixing chamber 28 is said to be off-axis. Because of the off-axis location of mixing chamber 28 the abrasive particles 47 in the mixing chamber 28 are mixed with the water passing through the passage in spindle 16 in the mixing chamber 28 before being sprayed with the water out of the nozzle 10 through focal tube 36.

The abrasive particles 47 pass through the inlets 46 into the mixing chamber 28 from a port 50 in housing 12, the port 50 being provided with a replaceable wear sleeve 52 to avoid damage to the housing 12 from impingement of the abrasive particles against the metal comprising housing 12. In a particularly preferred embodiment, the abrasive particles are pumped or otherwise forced through a line 54 into the port 50 in housing 10 from a reservoir (not shown).

Returning now to the longitudinal passage through spindle 16, it can be seen that the passage is provided with a jewel nozzle 56 preferably located at the junction of the first, coincident section 42 of the passage and the second, angled section 44 of the passage. Jewel nozzle 56 is introduced into the longitudinal passage through spindle 16 from the direction of the second, angled end of spindle 16, the large diameter portion 58 of which forms the mixing chamber 28. In the preferred embodiment shown, jewel nozzle 56 is held in place in the longitudinal passage 42, 44 through spindle 16 by threaded engagement but those skilled in the art will recognize the jewel nozzle can also be press fit into the passage 42, 44. Those skilled in the art will also recognize from this disclosure that jewel nozzle 56 is not essential and that the desirable pressure of the water passing through passage 42, 44 can also be obtained by a restriction in the diameter of the passage 42, 44 and that jewel nozzle 56 need not be located at the junction of the first and second sections 42, 44 of the passage.

In the preferred embodiment shown, the longitudinal axis of focal tube 36 is substantially coincident with the longitudinal axis of the second, angled section 44 of the longitudinal passage 42, 44 through spindle 16, and in an appropriately sized bore 62 in focal tube housing 34, by an appropriate adhesive. In alternative embodiments, focal tube 36 is threadably engaged to focal tube housing 34 or pinned in place in the focal tube housing 34. As described above, focal tube housing 34 is received within the bore 32 in the socket 30 of spindle 16 and retained in the bore 32 by engagement of the locking collar 38. An O-ring or other appropriate seal 64 residing in a shallow bore 65 is compressed between focal tube housing 34 and the bottom of the socket 30 when locking collar 38 is tightened. As visible in FIG. 1, the fit between the outside diameter (O.D.) of focal tube housing 34 and the inside diameter (I.D.) of the bore 32 in socket 30 is not a tight fit. Because of the space between the O.D. of focal tube housing 34 and the I.D. of the bore 32, the focal tube housing 34 can be positioned in the bore 32 to align the passage 66 through focal tube 36 with the outlet of the jewel nozzle 56 in the longitudinal passage 42, 44 through spindle 16. At the high pressures of the water passing through these passages, this alignment of the passage 66 through focal tube 36 and the outlet of the pressure nozzle 56 substantially increases the life expectancy of the nozzle of the present invention. To facilitate the tightening and loosening of the locking collar 38 from the socket 30 of spindle 16, holes 68 and 70 are provided in locking collar 38 and socket 30, respectively, the hole 70 in socket 30 being accessed through a bore 72 through the wall of housing 12. A seal 74 is also provided between the O.D. of socket 30 and the I.D. of the housing 12.

In operation, the rotating lance (not shown) to which collar 24 is engaged causes the collar 24, spindle 16, and focal tube 36 and focal tube housing 34 all to rotate within housing 12 along the axis of rotation 43. That rotation, which is off-axis in the mixing chamber 28 at the point at which the abrasive particles 47 are introduced into the water passing through the longitudinal passage 42, 44, mixes the abrasive particles 47 into the stream of water so that, when the water exits the spinning end of focal tube 36, the mixed water/abrasive stream defines a circular stream, the diameter of the circle being defined by the distance the nozzle 10 is held from the surface on which the stream impinges. The mixing of the abrasive with the water enables a broader circular pattern than is available with known rotating pressure nozzles while still maintaining the effectiveness of the stream in removing paint or other coatings, rust, scale, etc. from the surface on which the stream impinges.

Those skilled in the art who have the benefit of this disclosure will recognize that certain changes can be made to the component parts of the apparatus of the present invention without changing the manner in which those parts function to achieve their intended result. For instance, although shown in the figures as being monolithic, the spindle 16 of the present invention may be comprised of multiple parts that are threadably or otherwise engaged to each other. Similarly, the collar 24 of the nozzle 10 shown in the figures can be omitted and the end 22 of the shaft 17 of spindle 16 configured to mount directly to a rotating lance. All such changes, and others which will be clear to those skilled in the art from this description of the preferred embodiments of the invention, are intended to fall within the scope of the following, non-limiting claims.

What is claimed is:

1. A nozzle for spraying abrasive particles mixed in water comprising:

a housing:

a spindle rotatable in said housing and having a passage therethrough for the flow of water, a first portion of the passage being approximately coincident with a rotational axis of said spindle and a second portion of the passage having an axis that is angled relative to the first portion of the passage;

a focal tube positioned in the second portion of the passage through said spindle and rotatable therewith having a bore therethrough for passing the flow of water from said spindle and out of said housing;

a chamber in the second, angled portion of the passage through said spindle; and at least one inlet into said chamber for introducing abrasive particles into the flow of water passing through said spindle, the abrasive particles being mixed with water off-axis rotation of said chamber before the mixture of water and abrasive particles enters the bore through said focal tube.

2. The nozzle of claim 1 wherein said-focal tube is mounted in a bore through a focal tube housing, said focal tube-housing being rotatable with said spindle.

3. The nozzle of claim 1 additionally comprising a collar adaptable for connecting said spindle to a rotating lance for introducing a flow of water into said spindle and rotating said spindle.

4. The nozzle of claim 2 wherein said focal tube is either adhered to said focal tube housing, threadably engaged to said focal tube housing, or pinned in place in said focal tube housing.

5. The nozzle of claim 2 wherein the longitudinal axis of said focal tube is substantially coincident with the longitudinal axis of the bore through said focal tube housing.

6. A method of spraying abrasive particles in water comprising the steps of:

rotating a spindle having a passage therethrough for passing water in a housing;

rotating a focal tube with the spindle, the focal tube having a bore therethrough for passing the water from said spindle out of the housing; and mixing abrasive particles with the water in an off-axis chamber in fluid communication with the passage through the spindle before the water exits the housing through the bore in the focal tube.

7. The method of claim 6 additionally comprising forcing the abrasive particles into the off-axis chamber.

* * * * *